United States Patent [19]

Hoshikawa et al.

[11] Patent Number: 4,617,433

[45] Date of Patent: Oct. 14, 1986

[54] PRESSURE-SENSITIVE CONDUCTIVE STRIP SWITCH ASSEMBLY AND A METHOD OF MANUFACTURING THE SAME

[75] Inventors: Kyofu Hoshikawa; Seishiro Ishiwatari; Mitsuru Tanahashi, all of Tokyo, Japan

[73] Assignees: Bridgestone Corporation; Shinmei Rubber Ind., Co., Ltd., both of Japan

[21] Appl. No.: 746,691

[22] Filed: Jun. 20, 1985

[30] Foreign Application Priority Data

Jun. 25, 1984 [JP] Japan ..... 59-129172

[51] Int. Cl.[4] ..... H01H 3/16

[52] U.S. Cl. ..... 200/86 R; 200/86.5; 264/104; 264/173; 340/666

[58] Field of Search ..... 307/119; 340/665, 666, 340/667; 338/114; 200/85 R, 85 A, 86 R, 86 A, 302, 86.5, 159 B; 361/170, 188; 264/173, 174, 104, 514, 565, 566

[56] References Cited

U.S. PATENT DOCUMENTS

| | | | |
|---|---|---|---|
| 3,227,786 | 1/1966 | Cohen | 264/565 |
| 3,830,991 | 8/1974 | Durocher | 200/86 R |
| 4,272,471 | 6/1981 | Walker | 264/104 |
| 4,497,989 | 2/1985 | Miller | 200/86 R |

*Primary Examiner*—G. P. Tolin

*Attorney, Agent, or Firm*—Sughrue, Mion, Zinn, Macpeak and Seas

[57] ABSTRACT

A pressure-sensitive conductive strip switch assembly having high reliability and sensitivity is disclosed, which comprises a strip-like pressure-sensitive conductive rubber based on silicone containing metal powder, a pair of strip-like plain woven metal wire cloths, and a rubber sheath consisting of heat resistant silicone rubber. In the manufacture of such a strip switch assembly both side ends of the conductive rubber are welded to the inner wall of the rubber sheath and only the outside of each of the wire cloths is edged into the inner wall of the rubber sheath while maintaining space portion between the conductive rubber and each of the wire cloths by blowing of air.

2 Claims, 2 Drawing Figures

PRESSURE-SENSITIVE CONDUCTIVE STRIP SWITCH ASSEMBLY AND A METHOD OF MANUFACTURING THE SAME

BACKGROUND OF THE INVENTION

1. Field of the Invention

This invention relates to a pressure-sensitive conductive strip switch assembly having a high sensitivity and to a method of manufacturing the same without a substantially high number of reject products.

2. Description of the Prior Art

The switch of this type comprises a pressure-sensitive conductive rubber, a pair of conductive materials such as metal wire cloths of plain weave sandwiching the conductive rubber therebetween, and a rubber sheath covering them. Since such a switch must be continuously manufactured as a continuous length at a thickness as thin as possible, however, there have hitherto been many problems in the manufacturing technique.

For instance, it is difficult to maintain the sandwich structure of the conductive rubber and the conductive materials at a proper arranging state inside the rubber sheath, resulting in the formation of short-circuit in the finished product. Alternatively, a part of the rubber sheath may get inside of the conductive material to produce an insulation portion in the finished product. As a result, the manufacture of the conventional pressure-sensitive conductive switch is very low in reliability.

SUMMARY OF THE INVENTION

It is, therefore, an object of the invention to solve the above problems of the prior art and to provide a pressure-sensitive conductive strip switch assmebly and a method of manufacturing the same.

According to a first aspect of the invention, there is the provision of a pressure-sensitive conductive strip switch assembly comprising a strip-like pressure-sensitive conductive rubber based on silicone containing metal powder therein, a pair of strip-like plain woven metal wire cloths sandwiching the conductive rubber therebetween through space portions, and a rubber sheath covering them and made of heat-resistant silicone rubber, both side ends of the conductive rubber being welded to the inner wall of the rubber sheath, and only the outside of each of the metal wire cloths being edged into the inner wall of the rubber sheath.

According to a second aspect of the invention, there is the provision of a method of manufacturing a pressure-sensitive conductive strip switch assembly, which comprises introducing a pair of strip-like plain woven metal wire cloths into a tubing machine with sandwiching therebetween a strip-like pressure-sensitive conductive rubber based on silicone containing metal powder at given intervals, pulling out the assembly of the conductive rubber and the wire cloths in the direction of a nozzle while blowing air into a space between the conductive rubber and the wire cloth, extruding a heat resistant silicone rubber in the form of tube around the assembly by means of the tubing machine as a rubber sheath to cover the conductor assembly of the conductive rubber and the wire cloths in the nozzle in such a manner that both side ends of the conductive rubber is welded to the inner wall of the rubber sheath and only the outside of each of the wire cloths is edged into the inner wall of the rubber sheath while forming a space portion between the conductive rubber and the wire cloth, and drawing out the resulting pressure-sensitive conductive strip switch assembly from the nozzle.

DETAILED DESCRIPTION OF THE PREFERRED EMBODIMENT

Figure 1:
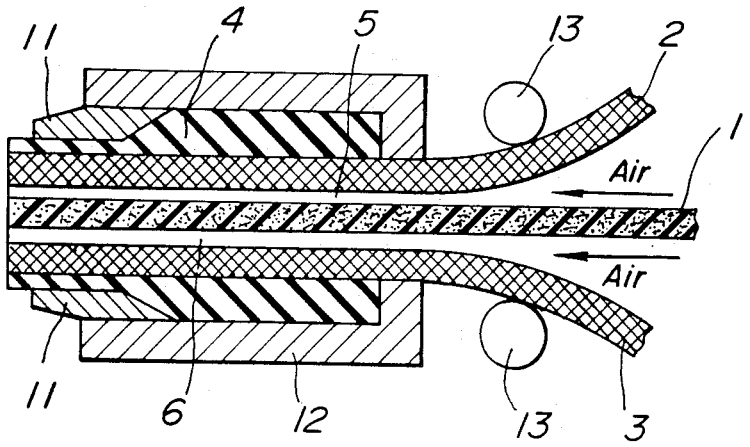
FIG. 1 is a longitudinal sectional view illustrating an outline of an apparatus used in the method of the invention.

As shown in FIG. 1, a strip-like pressure-sensitive conductive rubber 1, which is based on a silicone rubber and contains metal powder therein, is introduced together with a pair of strip-like plain woven metal wire cloths 2, 3 sandwiching the conductive rubber 1 therebetween at a given interval into a tubing machine 12. In the machine 12, a heat-resistant silicone rubber is extruded around the assembly of the conductive rubber 1 and the wire cloths 2, 3 in the form of tube to form a rubber sheath 4. Thereafter the resulting pressure-sensitive conductive strip switch assembly is drawn out from a nozzle 11 of the tubing machine 12.

Figure 2:
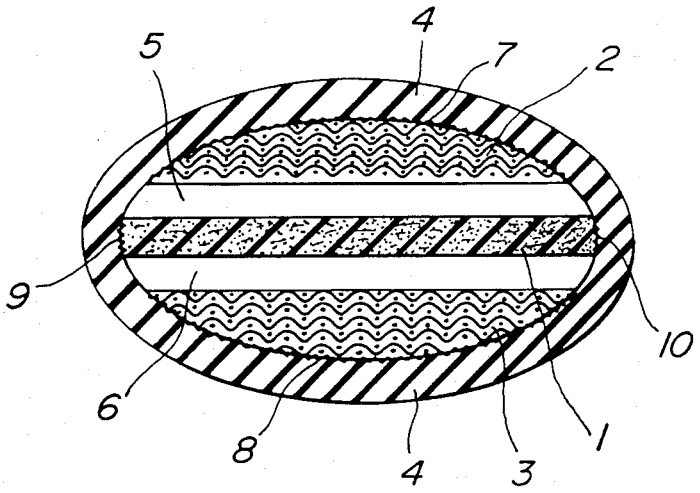
FIG. 2 is a sectional view of a strip switch assembly according to the invention.

When the conductive rubber 1 and the wire cloths 2, 3 are introduced into the tubing machine, the wire cloths 2, 3 are moved in the direction of the nozzle 11 under tension through a pair of support shafts 13 located at the front of the inlet of the tubing machine. The distance between which shafts is larger than the size of the inlet, so as not to put the metal cloths 2, 3 close to the conductive rubber 1, while air of a predetermined pressure is blown between the conductive rubber 1 and the wire cloths 2, 3 near the inlet in an arrow direction. Thus space portions 5, 6 are surely and forcibly formed between the conductive rubber 1 and the wire cloths 2, 3. Further, since the wire cloths 2, 3 are drawn out from the nozzle 11 under tension, they are easy to be edged at their outside into the inner wall of the rubber sheath 4 formed by extruding the heat-resistant silicone rubber in the form of tube near the nozzle 11 of the tubing machine 12. In this way, the pressure-sensitive conductive strip switch assembly having the sectional structure as shown in FIG. 2 can be continuously manufactured without trouble.

Moreover, since both the rubber sheath 4 and conductive rubber 1 are based on silicone rubber, both side ends of the conductive rubber 1 form sealed portions 9, 10 at the inner wall of the rubber sheath. On the other hand, edged portions 7, 8 are only formed between each outside of the wire cloths 2, 3 and the inner wall of the rubber sheath 4. Therefore, the space portions 5, 6 can be properly maintained without moving the conductive rubber 1 and the wire cloths 2, 3 inside the rubber sheath. Consequently there is no fear that continuity occurs except for using it as a switch.

In addition, since the rubber sheath 4 is formed while blowing air and moving the wire cloths 2, 3 under tension, the space portions 5, 6 can surely and easily be formed. Therefore, even when any position of the finished product is operated as a switch, a proper switching function can be attained.

The edged portions 7, 8 are formed so that a part of the inner wall of the rubber sheath 4 penetrates into interstices of the wire cloths 2, 3. On the other hand, the sealed portions 9, 10 are easily sealable to the rubber sheath 4 because the conductive rubber 1 and the rubber sheath 4 are based on silicone rubber. As a result, a sure sealed state can be realized.

In this way, the pressure-sensitive conductive strip switch assembly is manufactured with a high degree of reliability since, even when it is formed as a thin strip, the space portions 5, 6 are surely formed. And also, the switching operation having a high sensitivity can be expected due to the thin strip.

As mentioned above, according to the invention, the proper pressure-sensitive conductive strip switch assembly having a high sensitivity can be manufactured by a simple method in a high efficiency and a mass production.

What is claimed is:

1. A pressure-sensitive conductive strip switch assembly comprising a strip-like pressure-sensitive conductive rubber based on silicone containing metal powder therein, a pair of strip-like plain woven metal wire cloths sandwiching the conductive rubber therebetween through space portions, and a rubber sheath covering them and made of heat-resistant silicone rubber, both side ends of the conductive rubber being welded to the inner wall of the rubber sheath, and only the outside of each of the metal wire cloths being edged into the inner wall of the rubber sheath.

2. A method of manufacturing a pressure-sensitive conductive strip switch assembly, which comprises introducing a pair of strip-like plain woven metal wire cloths into a tubing machine with sandwiching therebetween a strip-like pressure-sensitive conductive rubber based on silicone containing metal powder at given inervals, pulling out the assembly of the conductive rubber and the wire cloths in the direction of a nozzle while blowing air into a space between the conductive rubber and the wire cloth, extruding a heat-resistant silicone rubber in the form of tube around the assembly by means of the tubing machine as a rubber sheath to cover the conductor assembly of the conductive rubber and the wire cloths in the nozzle in such a manner that both side ends of the conductive rubber are welded to the inner wall of the rubber sheath and only the outside of each of the wire cloths is edged into the inner wall of the rubber sheath while forming a space portion between the conductive rubber and the wire cloth, and drawing out the resulting pressure-sensitive conductive strip switch assembly from the nozzle.

* * * * *